US007575344B2

(12) United States Patent
Lin et al.

(10) Patent No.: US 7,575,344 B2
(45) Date of Patent: Aug. 18, 2009

(54) LAMP FIXTURE

(75) Inventors: Jian-Shian Lin, Yilan County (TW); Chieh-Lung Lai, Taichung County (TW); Jen-Hui Tsai, Hsinchu (TW); Tung-Chuan Wu, Hsinchu (TW)

(73) Assignee: Industrial Technology Research Institute, Hsin-Chu (TW)

( * ) Notice: Subject to any disclaimer, the term of this patent is extended or adjusted under 35 U.S.C. 154(b) by 129 days.

(21) Appl. No.: 11/774,561

(22) Filed: Jul. 7, 2007

(65) Prior Publication Data

US 2008/0253129 A1 Oct. 16, 2008

(30) Foreign Application Priority Data

Apr. 10, 2007 (TW) ..... 96112401 A

(51) Int. Cl.
*F21V 5/02* (2006.01)

(52) U.S. Cl. ..... 362/339; 362/338; 362/336; 362/337

(58) Field of Classification Search ..... 362/500–545
See application file for complete search history.

(56) References Cited

U.S. PATENT DOCUMENTS 4,053,208 A * 10/1977 Kato et al. ..... 359/460
5,577,492 A * 11/1996 Parkyn et al. ..... 126/698
5,577,493 A * 11/1996 Parkyn et al. ..... 126/699
5,676,453 A * 10/1997 Parkyn et al. ..... 362/260
6,352,359 B1 * 3/2002 Shie et al. ..... 362/522
7,470,047 B2 * 12/2008 Lin et al. ..... 362/339
2005/0129357 A1 6/2005 Yang et al.
2006/0139933 A1 6/2006 Lin et al.
2006/0232976 A1 10/2006 Lin et al.

FOREIGN PATENT DOCUMENTS

TW M291538 11/1996
TW M291539 6/2006

* cited by examiner

*Primary Examiner*—Anabel M Ton
(74) *Attorney, Agent, or Firm*—WPAT, PC; Justin I. King

(57) ABSTRACT

An improved lamp fixture with anti-glare function is disclosed, which comprises: a lamp; a light source; and a light-control unit, composed of a semi-Fresnel microstructure and a light-control microstructure; wherein the light source and the light-control unit are mounted on the lamp; and the semi-Fresnel microstructure is used for diffusing/collimating light of the light source while the light-control microstructure is used for controlling the resulting lighting angle. With the aforesaid lamp fixture, not only glare can be prevented, but also uniformity of the lamp fixture is improved.

21 Claims, 7 Drawing Sheets

LAMP FIXTURE

FIELD OF THE INVENTION

The present invention relates to an improved lamp fixture with anti-glare function, and more particularly, to an anti-glare desktop lamp capable of controlling its lighting direction and distribution by the formation of a semi-Fresnel microstructure and a light-control microstructure without adversely affecting its light efficiency, and thereby, not only glare can be prevented, but also uniformity of the lamp is improved.

BACKGROUND OF THE INVENTION

There are three types of glare: direct, contrast and indirect. Direct glare occurs when there are bright light sources directly in the operator's field of view. Windows are often a source of direct glare, or one may experience the direct glare by looking straightly to the sun or a light bulb. Contrast glare is where one part of the vision area is much brighter than another. Usually it is caused by large differences in light levels within the visual field. For example, it may happen when there are two light sources illuminating a same general area, such as a study room, in that an area light such as the luminaire fitted on the ceiling is used for lighting the whole study room while a task light such as a desktop lamp is used for lighting a working area on the desk, thereby, large differences in light levels will be caused in the visual field. Moreover, indirect glare occurs when light from windows or overhead lighting is reflected off shiny surfaces in the field of view, such as terminal screens, desks and other office equipment, which is considered to be the most commonly experienced glare and is the one that causes most discomfort to human eye. One important fact must be remembered: glare is light—it is impossible to alter glare without altering the light entering through the glazing. Therefore, as the indirect glare viewed in the field of view is substantially a kind of secondary light originating from and reflected by a glassy surface of a reading material being viewed by a person, the glare troubling the person, being the reflection of the light shining on the reading material, is impossible to be avoided without changing his or her normal orientation to the reading material.

Indirect glare can be a significant problem, since it may be the cause of burred images, strenuous reading, low reading efficiency, and even severe eyestrain and headaches. Many researches had indicated that four out of five working professionals are troubled by some kinds of visual discomfort and have symptoms such as headache, eye fatigue or watering eye. Statistically, within a sample group of students, more than 55.9% of them specify that it is common for them to be troubled by eyestrain, watering eye, etc. while studying under the lighting of desk lamps.

For dealing with those visual discomfort problems caused by indirect glare, many anti-glare structures had been provided which can be divided into three types: structures with anti-glare reflective filter, structures with anti-glare reflective screen and structures with optical chopper.

For those anti-glare structures with anti-glare reflective filter, it is common to design a reflective filter at the lighting direction of a light source so that only light of vertical polarization is allowed to pass through the reflective filter while other light of parallel polarization is reflected for converting into vertical polarization, thereby, indirect glare can be reduced. Moreover, a diffusive film matching with the reflective filter is usually being designed in such anti-glare structures, by which light can be diffused uniformly before shining on the reflective filter so that even when a person is looking directly at such anti-glare structures, it can prevent the person from seeing and identifying the exact light source and thus the adverse effect of direct glare is reduced. However, since the use of such reflective filter will result a portion of light to be dissipate during the reflection, the light efficiency and the brightness of any luminaire using such anti-glare structures are reduced and thus may not be satisfactory.

For those anti-glare structures with anti-glare reflective screen, it is common to design a reflective screen surrounding a light source of a luminaire so that the reflective screen will reflect and direct the light of the light source to shine perpendicularly toward a desired working area on a desk, thereby, indirect glare can be reduced as light reflected from the glassy surface of the working area will not shine directly to human eyes. Moreover, a soft screen matching with the reflective screen is usually being designed in such anti-glare structures, by which light can be scattered even when a person is looking directly at such anti-glare structures, it can prevent the person from seeing and identifying the exact light source and thus the adverse effect of direct glare is reduced. However, it is disadvantageous in that: the use of such reflective screen will result in the luminaire to have smaller lighting area, not to mention that it is much more complicated to design and manufacture. In addition, any luminaire designed with such soft screen will have poor light efficiency inferior to those without.

For those anti-glare structures with optical chopper, it is common to design an optical chopper surrounding a light source of a luminaire for controlling the lighting direction of the light source, by which not only glare can be prevented, but also most light emitted from the light source can be used effectively and thus the efficiency of the light source is increased. However, it is disadvantageous in that: the use of such reflective screen will result in the luminaire to have smaller lighting area, not to mention that the overall light efficiency of the luminaire is adversely affected.

From the above description, it is noted that although those conventional anti-glare structures can function effectively in glare improvement, they are all suffered by problems of smaller lighting area and lower light efficiency.

There are several researches trying to develop an anti-glare structure with improved light efficiency and uniformity. One such research is a lighting device disclosed in U.S. Pub. No. 20060232976, entitled "Lighting Device With Integration Sheet", as seen in FIG. 1. The lighting device of FIG. 1 comprises: a light source 21 having a luminous body 211 and a reflecting screen 212; and a sheet 22, being disposed at the light emitting end of the light source 21, each comprising a plurality of light diffusion zones, represented by the three light diffusion zones 221, 222, 223; wherein each light diffusion zone has a plural arrays of microstructures arranged on the surface thereof, and each array of microstructures is capable of changing the diopter of the corresponding light diffusion zone. By the arrays of microstructures distributed in the light diffusion zones 221, 222, 223, the light incident thereon can be diffused and shine upon the intended illuminating area 9 uniformally while the ineffective portion of light that points to the area outside the intended illuminating area 9 is collimated to shine upon the intended illuminating area 9. Thereby, not only the light efficiency of the light device can be enhanced, but also uniformity of the lighting device is improved.

Another such research is a luminaire disclosed in U.S. Pub. No. 20060139933, entitled "Reflector With Negative Focal Length", as seen in FIG. 2. In FIG. 2, the top of the luminaire screen 20 is a reflector of single negative focal length 51, such that the cross section of the luminaire screen 20 is a concavity with a side screen 52 connecting to the edge of the reflector 51. By the luminaire screen 20 of FIG. 2, the upward-incident rays emitting from a light source 53 are first reflected to the side screen 52 by the reflector 51, and then are further reflected such that a plurality of discharging rays 54 are generated. It is noted that the discharging rays 54 are discharge out of the luminaire by large angles for reducing glare. In addition, the height of the luminaire can be reduced.

Yet, another such research is a light guide apparatus disclosed in U.S. Pub. No. 20050129357, entitled "Light Guide Apparatus for Enhancing Light Source Utilization Efficiency", as seen in FIG. 3. In FIG. 3, a light guide apparatus for enhancing light source utilization efficiency 30 includes a light guide sheet 32, a light coupling structure 301 and a light emerging structure 302. The light coupling structure 301 is arranged on a surface of the light guide sheet 32 and opposite to a light source 31. The light emerging structure 302 is disposed on a surface of light guide sheet 32 that can be the same as, or opposite to that of the light coupling structure 301. Lights emitted by the light source 31 enters into the light guide sheet 32 via the light coupling structure 301 and evenly emitted to outer environment via said light emerging structure 302, thereby enhancing light source utilization efficiency Although the means of the aforesaid researches are different from each other, they all can achieve the purposes of lighting efficacy enhancement and illuminance uniformity improvement. Nevertheless, it is still in need of an apparatus capable of preventing glare while achieving the purposes of lighting efficacy enhancement and illuminance uniformity improvement.

SUMMARY OF THE INVENTION

In view of the disadvantages of prior art, the object of the present invention is to provide an anti-glare desktop lamp capable of controlling its lighting direction and distribution by the formation of a semi-Fresnel microstructure and a light-control unit without adversely affecting its light efficiency, and thereby, not only glare can be prevented, but also uniformity of the lamp is improved.

To achieve the above object, the present invention provides an improved lamp fixture with anti-glare function, which comprises: a lamp; a light source; and a light-control unit, composed of a semi-Fresnel microstructure and a light-control microstructure; wherein the light source and the light-control unit are mounted on the lamp; and the semi-Fresnel microstructure is used for diffusing/collimating light of the light source while the light-control microstructure is used for controlling the resulting lighting angle for improving illuminance uniformity; and the light-control microstructure is substantially a microstructure array of symmetrical or unsymmetrical shape.

Preferably, the semi-Fresnel microstructure is coplanar with the light-control microstructure, whereas the light-control microstructure and the semi-Fresnel microstructure are structured respectively as an array selected from the group consisting of a regular and an irregular array.

Preferably, elements of the semi-Fresnel microstructure are disposed at two sides of the light-control microstructure in a symmetrical manner.

Preferably, the semi-Fresnel microstructure is disposed on a surface different from that of the light-control microstructure, whereas the light-control microstructure and the semi-Fresnel microstructure are structured respectively as an array selected from the group consisting of a regular and an irregular array.

Preferably, elements of the semi-Fresnel microstructure are disposed on at least one surface of a flat sheet-like substrate.

Preferably, the semi-Fresnel microstructure and the light-control microstructure are disposed on the same flat sheet-like substrate.

Preferably, the semi-Fresnel microstructure is disposed on one surface of a flat sheet-like substrate while the light-control microstructure is disposed on another surface the flat sheet-like substrate opposite thereto.

Preferably, at least one surface of a flat sheet-like substrate is formed with the semi-Fresnel microstructure and the light-control microstructure in a coplanar manner.

Preferably, the improved lamp fixture with anti-glare function further comprises a screen, which includes: at least a reflective surface, capable of reflecting light emitting from the light source; and at least a light exit, provided for receiving the light-control unit while allowing light to be discharged out of the screen therefrom.

Preferably, rays emitting from the light source are reflected by the reflective surface to shine on the light-control unit.

Preferably, the light source is received inside the screen.

Preferably, a reflective layer is formed on the reflective surface, which can be a reflective diffusing film, or an electroplating coating of a metal selected from the group consisting of aluminum, electroless nickel and the likes.

In an exemplary embodiment of the invention, the lamp further comprises: a base; a post, mounted on the base and provided for the light source and the light-control unit to be disposed thereon; and a switch, disposed on the base while electrically connected to a power source.

Preferably, the light source is at least a device selected from the group consisting of an incandescent bulb, a fluorescent lamp, a light emitted diode and the combination thereof.

Preferably, rays of the light source is emanating directly toward the light-control unit.

Preferably, the semi-Fresnel microstructure is composed of a plurality of reflective microelements, each capable of reflecting light.

Preferably, the semi-Fresnel microstructure is composed of a plurality of refractive microelements, each capable of refracting light.

Preferably, the light-control microstructure is a composition of microstructures, each selected from the group consisting of a refractive microelement, a diffusion micro-particle, a diffusion pore and the combination thereof.

Preferably, the light-control microstructure is substantially a microstructure array of symmetrical or unsymmetrical shape.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several preferable embodiments cooperating with detailed description are presented as the follows.

Figure 1:
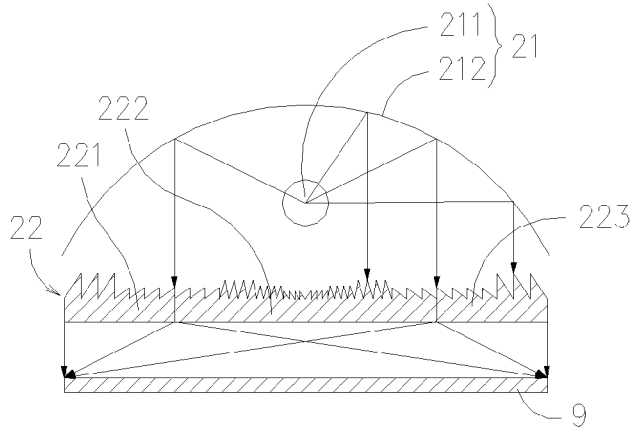
FIG. 1 is a schematic view of a lighting device disclosed in U.S. Pub. No. 20060232976.
Figure 2:
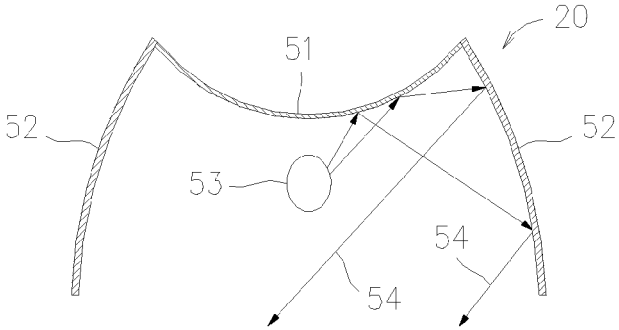
FIG. 2 is a schematic view of a luminaire disclosed in U.S. Pub. No. 20060139933.
Figure 3:
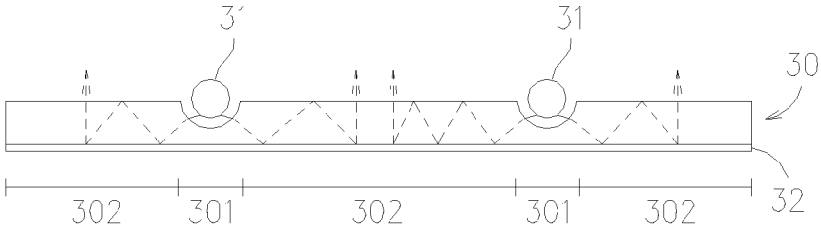
FIG. 3 is a schematic view of a light guide apparatus disclosed in U.S. Pub. No. 20050129357.
Figure 4:
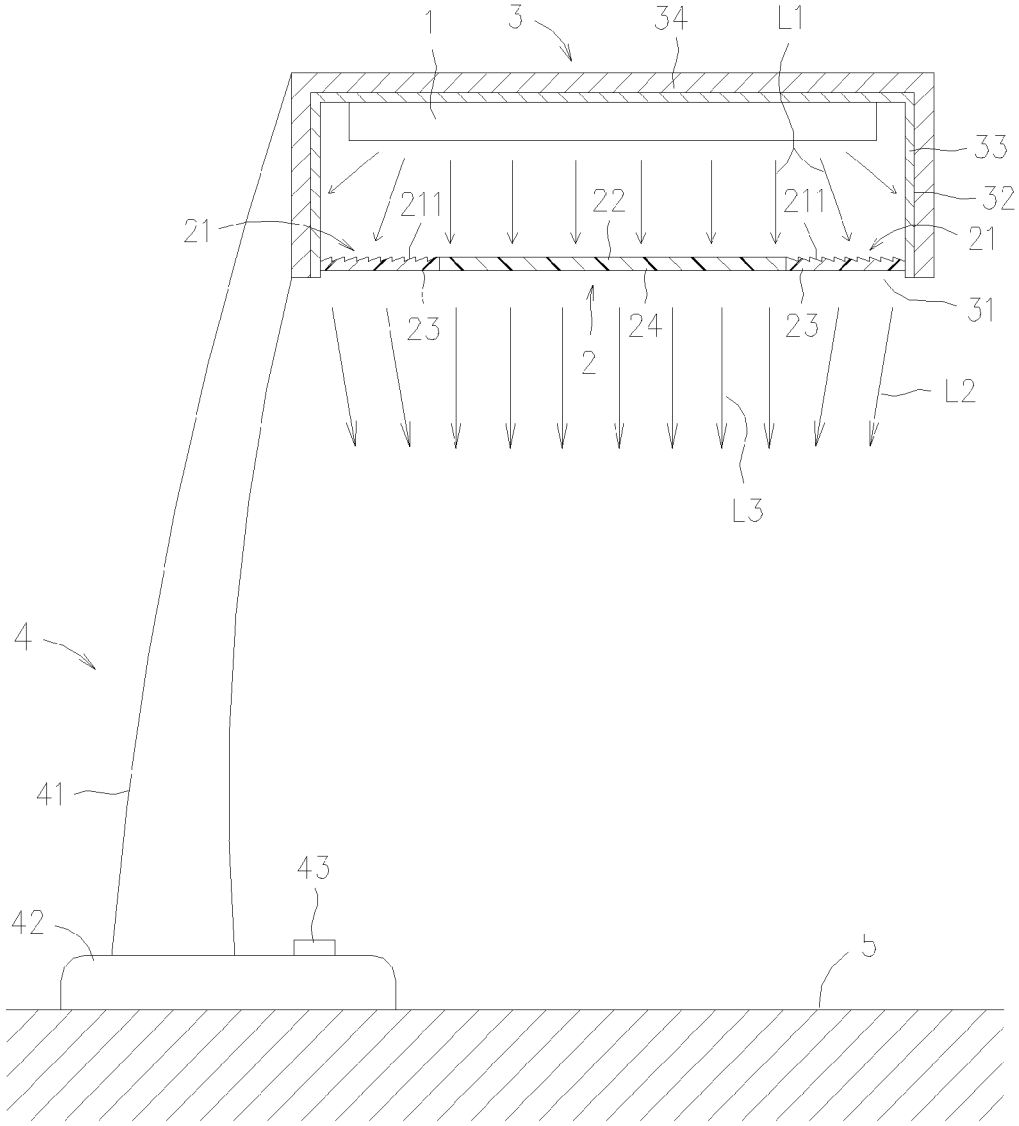
FIG. 4 is a cross-sectional view of an improved lamp fixture with anti-glare function according to an exemplary embodiment of the invention.

Please refer to FIG. 4, which is a cross-sectional view of an improved lamp fixture with anti-glare function according to an exemplary embodiment of the invention. The lamp fixture of FIG. 4 includes a light source 1, a light-control unit 2, a screen 3 and a lamp 4. The lamp 4 is composed of a post 41, a base 42 and at least a switch, represented by the one switch 43 shown in FIG. 4, in which the post 41 and the switch 43 are mounted on the base 42 while the base is placed on a surface 5, such as a desk top. As seen in FIG. 4, the light source 1, the light-control unit 2 and the screen 3 are all being mounted to the top of the post 41. As the switch 43 is mounted on the base 42, it can be connected to a power source, or even connected to mechanism structured with rotating shafts and motors, etc., through an electric circuit so as to be used for controlling the actuation of the lamp. However, the controlling of the lamp by the switch 43 is known to those skilled in the art and thus is not described further herein.

As seen in FIG. 4, the screen 3 is designed with at least a light exit, represented by the one light exit 31, in which the light source 1 is attached to an inner surface 34 of the screen 3 while the light-control unit 2 is disposed at the light exit 31. It is noted that the light source 1 can be an incandescent bulb, a fluorescent lamp, a light emitted diode or the combination thereof. In FIG. 4, rays L1 of the light source 1 shining upon different portions of the light-control unit 2 will be reflected or diffused, and thereafter discharged out of the light exit 31 as refracted rays L2 or diffused rays L3. As for the principle of the refraction and diffusion will be provided hereinafter. As a portion of the inner sidewall 32 of the screen 3 is manufactured with light-reflecting ability, by which a portion of rays L1 of the light source 1 shining upon the portion of inner sidewall 32 will be reflected toward the light-control unit 2, where they are diffused to be the diffused rays and then discharged out of the light exit 31, thereby, the light source utilization efficiency can be enhanced. In order to increase light reflection efficiency, a reflective layer 33 is disposed upon the portion of the inner sidewall 32, which can be a reflective diffusing film, or an electroplating coating of a metal selected from the group consisting of aluminum, electroless nickel and the likes.

The light-control unit 2 used in the lamp fixture with anti-glare function of the invention is composed of a semi-Fresnel microstructure 21 and a light-control microstructure 22, in which the semi-Fresnel microstructure 21 is capable of diffusing/collimating light of the light source and the light-control microstructure 22 is capable of controlling lighting angle of light discharging out of the lamp fixture for improving illuminance uniformity. Please refer to FIG. 5 and FIG. 6, which show a light-control unit 2 according to an exemplary embodiment of the invention. The light-control unit 2 is substantially a flat sheet-like substrate structured with two semi-circular portions 23 and a rectangular portion 24, in which the semi-Fresnel microstructure 21 is formed on one surface of each of the two semi-circular portions 23 while the light-control microstructure 22 is formed on one surface of the rectangular portion 24. In the exemplary embodiment shown in FIG. 4 and FIG. 6, the elements of the semi-Fresnel microstructure 21 are disposed symmetrically at two sides of the light-control microstructure 22 while the semi-Fresnel microstructure 21 is coplanar with the light-control microstructure 22.

Figure 5:
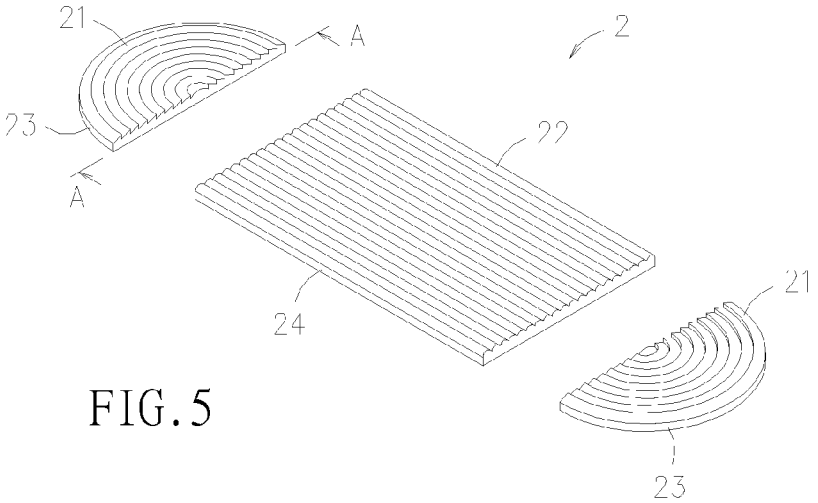
FIG. 5 is an exploded view of a light-control unit according to an exemplary embodiment of the invention.
Figure 6:
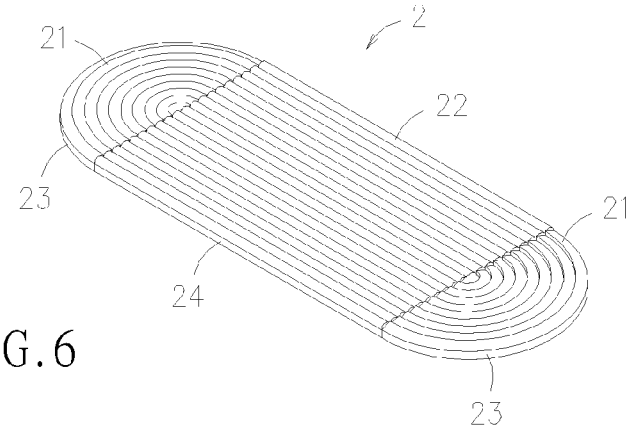
FIG. 6 is a perspective view of a light-control unit according to an exemplary embodiment of the invention.
Figure 7:
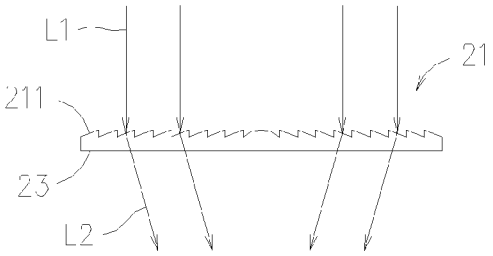
FIG. 7 is a schematic diagram depicting rays to be refracted by a semi-Fresnel microstructure used in an exemplary embodiment of the invention.

As the cross section of a semi-Fresnel microstructure 21 shown in FIG. 7, being the A-A cross section of FIG. 5, the semi-Fresnel microstructure 21 is composed of a plurality of microelements 211 which is similar to those of a conventional Fresnel lens and thus it is referred as semi-Fresnel microstructure. As known to those skilled in the art, the conventional Fresnel lens is succession of concentric rings, each consisting of an element of a simple lens, assembled in proper relationship on a flat surface to provide a short focal length, that it lens is used particularly to concentrate light rays into a relatively narrow beam. Similar to those conventional Fresnel lens, the semi-Fresnel microstructure 21 shown in the exemplary embodiment of FIG. 7 is composed of a plurality of microelements 211, each capable of refracting light. That is, when light rays L1 shine upon the microelements 211, they are refracted and then being discharged out of the semi-Fresnel microstructure 21 as refracted rays L2. In addition, the traveling path of those refracted rays L2 can be controlled to collimate or diffuse with respect to the center of the semi-Fresnel microstructure 21. As the semi-Fresnel microstructure 21 is formed on two semi-circular portions 23 which are disposed symmetrically at two sides of the light-control microstructure 22 as seen in FIG. 5 and FIG. 6, The refracted rays L2, generated either by the diffusion or by the collimation of the semi-Fresnel microstructure 21 formed on the two semi-circular portions 23 that is similar to those shown in FIG. 4, is either good for brightness enhancement or for softing light intensity. With respect to those rays L1 shining perpendicularly upon the light-control microstructure 22, they can be diffused by the light-control microstructure 22 and thus being converted into uniform-distributed diffused light L3. In an embodiment of the invention, the light-control microstructure 2 is a composition of microstructures, each selected from the group consisting of a refractive microelement, a diffusion micro-particle, a diffusion pore and the combination thereof; and the cross section of each microstructure is defined by a profile selected from the group consisting of an arc, a saw-toothed line, other irregular lines and the combination thereof, each ranged between several microns and hundreds of microns. In addition, the light-control microstructure 22 is substantially a microstructure array of symmetrical or unsymmetrical shape. It is intended to change the traveling path of light by refraction when it passes through the microelements 211 of the light-control microstructure 22. It is noted that the diffusion micro-particle and the diffusion pore, used as microelement 211 of the light-control microstructure 22, are respectively being structured similar to the diffusive bubbles shown in TW Pat. No. M291538 and M291539, which are capable of scattering light by the change of refractive index a light ray is experiencing when it is traveling trough the diffusion micro-particle or the diffusion pore. As the refraction of such refractive microelements, diffusion micro-particles, or diffusion pore can change the traveling direction of a light ray, they can be used for causing a light source to generate uniform illuminance. As seen in FIG. 5, the light-control microstructure 22 is formed on the rectangular portion 24 and is a composition of microstructures. However, for further enhancing the light to be uniformly distributed, diffusion micro-particles or diffusion pore can be doped into the rectangular portion 24. Similarly, those diffusion micro-particles or diffusion pore can also be doped into the two semi-circular portions 23. To sum up, the whole substrate of the light-control unit 2 can be doped with such diffusion micro-particles or diffusion pore so as to enhance uniformity.

It is to be noted that the structure and composition of the light-control unit 2 in the aforesaid embodiments have been set forth only for the purpose of disclosure and thus are not limited thereby. The characteristic of the light-control unit 2 is to use the cooperative operation of the semi-Fresnel microstructure 21 and the light-control microstructure 22 to change the traveling direction of light rays emitted from a light source so as to improve lighting uniformity while preventing the generation of glare. Please refer to FIG. 8 to FIG. 15, which are schematic diagrams showing various light-control units of the invention.

Figure 8:
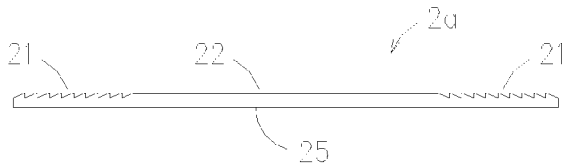
FIG. 8 to FIG. 15 are schematic diagrams showing various light-control units of the invention.

In FIG. 8, the light-control unit 2*a* is substantially a flat sheet-like substrate 25 structured with a semi-Fresnel microstructure 21 and a light-control microstructure 22 formed thereon in a coplanar manner while elements of the semi-Fresnel microstructure 21 are disposed symmetrically at two sides of the light-control microstructure 22. The difference between the light-control unit 2*a* of FIG. 8 form that shown in FIG. 4 is that the element of the semi-Fresnel microstructure 21 of FIG. 4 are formed on the two semi-circular portions 23 which are separated from the rectangular portion 24 having the light-control microstructure 22 formed thereon.

Figure 9:
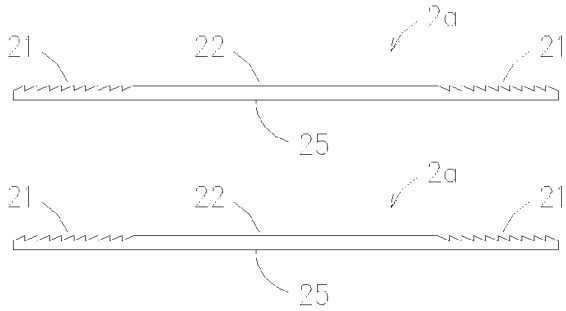

In FIG. 9, the light control unit is the lamination of two layer of such light-control unit 2*a* of FIG. 8. Furthermore, there can be three or more than three layers of such light-control unit 2*a* of FIG. 8 to be laminated and used as the light-control unit 2 similar to that shown in FIG. 9. Similarly, there can be more than two layers of such light-control units 2 of FIG. 4 to be laminated and used as the light-control unit 2 similar to that shown in FIG. 9.

Figure 10:
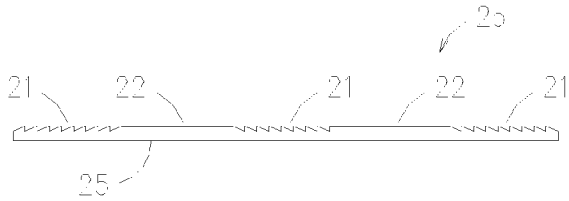

In FIG. 10, the light-control unit 2*b* is substantially a flat sheet-like substrate 25 structured with a semi-Fresnel microstructure 21 and a light-control microstructure 22 formed thereon in a coplanar manner while elements of the semi-Fresnel microstructure 21 and elements of the light-control microstructure 22 are disposed in an interposed manner.

Figure 11:
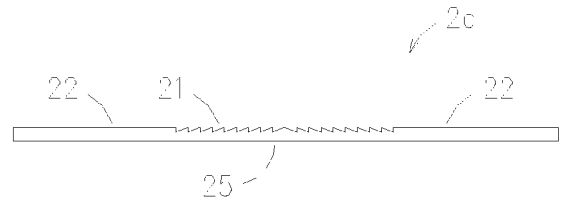

In FIG. 11, the light-control unit 2*c* is substantially a flat sheet-like substrate 25 structured with a semi-Fresnel microstructure 21 and a light-control microstructure 22 formed thereon in a coplanar manner while elements of the light-control microstructure 22 are disposed symmetrically at two sides of the semi-Fresnel microstructure 21.

It is noted that there can also be more than two layers of such light-control units 2*b*, 2*c* to be laminated and used as the light-control unit 2 similar to that shown in FIG. 9. In addition, one such multilayer light-control unit can be composed different types of layer selected from the light-control units 2, 2*a*, 2*b*, and 2*c*, respective illustrated in FIG. 4, FIG. 8~FIG. 11.

Figure 12:
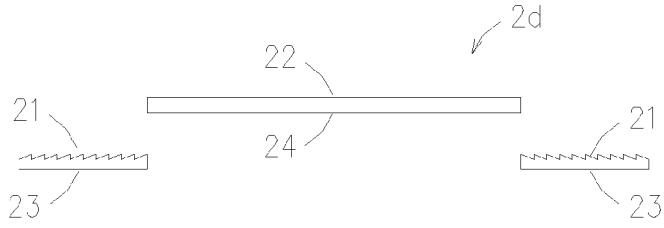

In FIG. 12, the light-control unit 2*d* includes: three substrates 23, 24, being detached from each other, in which one 24 is provide for the light-control microstructure 22 to be formed thereon while the other two 23 are provided for the semi-Fresnel microstructure 21 to be formed thereon. The disposition of the three substrates 23, 24 is to position the semi-Fresnel microstructure 21 on a level different from that of the light-control microstructure 22. In another exemplary embodiment, the light-control unit 2*d* can be a substrate with protruding/recessing surfaces, by which the light-control microstructure 22 and the semi-Fresnel microstructure 21 can be formed on surfaces of different levels so as to act the same as that of FIG. 12.

Figure 13:
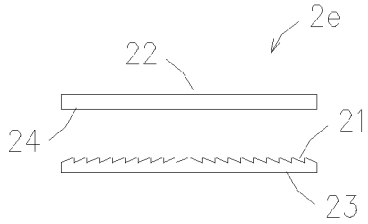

In FIG. 13, the light-control unit 2*e* includes: two substrates 23, 24, being detached from each other, in which one 24 is provide for the light-control microstructure 22 to be formed thereon while the other 23 is provided for the semi-Fresnel microstructure 21 to be formed thereon. In addition, the semi-Fresnel microstructure 21 is disposed on a level different from that of the light-control microstructure 22 by disposing the substrate 24 with the light-control microstructure 22 over the substrate 23 with the semi-Fresnel microstructure 21. Similarly, the semi-Fresnel microstructure 21 is disposed on a level different from that of the light-control microstructure 22 by disposing the substrate 24 with the light-control microstructure 22 under the substrate 23 with the semi-Fresnel microstructure 21.

Figure 14:
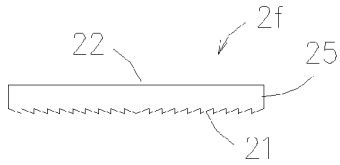

In FIG. 14, the light-control unit 2*f* is substantially a flat sheet-like substrate 25 structured with a semi-Fresnel microstructure 21 formed on a surface thereof and a light-control microstructure 22 formed on another surface opposite to that of the semi-Fresnel microstructure 21. In an exemplary embodiment, the semi-Fresnel microstructure 21 is formed on the top surface of the substrate 25 while the light-control microstructure 22 is formed on the bottom surface thereof; or vice versa.

Figure 15:
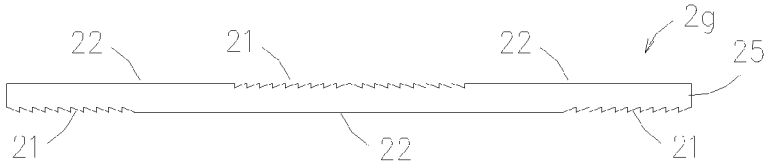

In FIG. 15, the light-control unit 2*g* is substantially a flat sheet-like substrate 25 structured with a semi-Fresnel microstructure 21 and a light-control microstructure 22 while enabling elements of the semi-Fresnel microstructure 21 and the light-control microstructure 22 to be disposed on the top and the bottom of the substrate 25 in an interposed manner.

Similarly, there can also be more than two layers of such light-control units 2*d*, 2*e*, 2*f*, 2*g* to be laminated and used as the light-control unit 2 similar to that shown in FIG. 9. In addition, one such multilayer light-control unit can be composed different types of layer selected from the light-control units 2*d*, 2*e*, 2*f*, 2*g*, respective illustrated in FIG. 12~FIG. 15.

Figure 16:
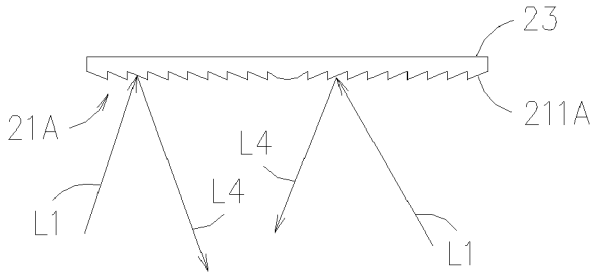
FIG. 16 is a schematic diagram depicting rays to be reflected by a semi-Fresnel microstructure used in an exemplary embodiment of the invention.

Please refer to FIG. 16, which is a schematic diagram depicting rays to be reflected by a semi-Fresnel microstructure used in an exemplary embodiment of the invention. As seen in FIG. 16, the semi-Fresnel microstructure 21A is composed of reflective microelements 211A, by which light shining thereon can be reflected into reflected light L4.

Figure 17:
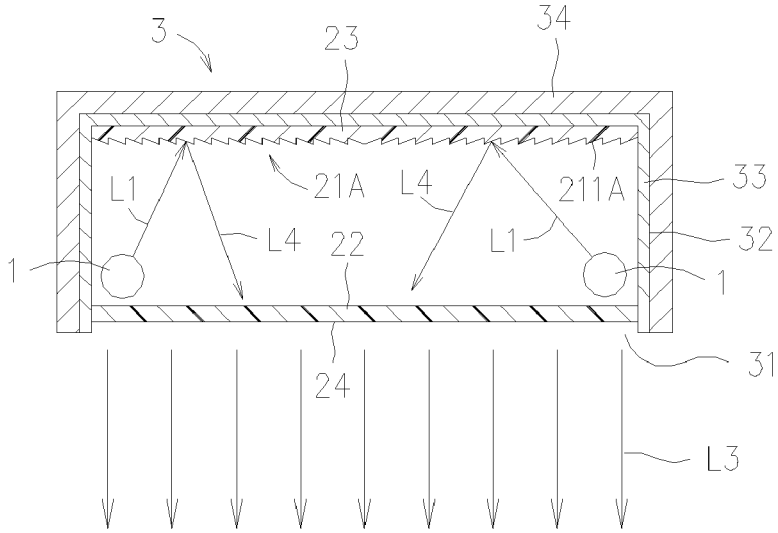
FIG. 17 is a cross section of a semi-Fresnel microstructure composed of a plurality of reflective microelements according to an exemplary embodiment of the invention.

Please refer to FIG. 17, which is a cross section of lamp fixture structured with a reflective semi-Fresnel microstructure 21A and a light-control microstructure 22 according to an exemplary embodiment of the invention. In FIG. 17, the lamp fixture is comprised of a screen 3 with a light exit 31, similar to that shown in FIG. 4. In addition, there is a reflective layer 33 being disposed at the inner sidewall 32 of the screen 3. As the semi-Fresnel microstructure adopted by the lamp fixture is a semi-Fresnel microstructure 21A with reflective microelements 211A, the reflective semi-Fresnel microstructure 21A is disposed at the bottom 34 of the screen 3 while the light sources 1 of the lamp fixture is positioned adjacent to the inner sidewall 32. In an embodiment of the invention, each light source 1 can be a directional light source, such as light emitting diode, whose lighting direction can be controlled for directing light rays L1 to shine on the microelements 211A effectively, so that the corresponding reflected light ray L4 can be collimated to shine on the light-control microstructure 22 disposed at the light exit 31, by which uniform-distributed diffused light ray L3 can be generated and discharged out of the screen through the light exit 31.

From those exemplary embodiments disclosed in FIG. 8 to FIG. 15, it is noted that both the semi-Fresnel microstructure and the light-control microstructure can be microelement arrays of regular or irregular shape, that can be coplanar-disposed or can be disposed on surfaces of different level. For instance, they can be disposed on a same surface of a same substrate or can be disposed on different surfaces of a same substrate.

To sum up, the improve lamp fixture with anti-glare function of the invention is characterized in its matching semi-Fresnel microstructure and light-control microstructure, by which not only the distribution of light can be controlled without adversely affecting its light efficiency, but also glare can be prevented and the uniformity of the lamp is improved as well.

Figure 18A:
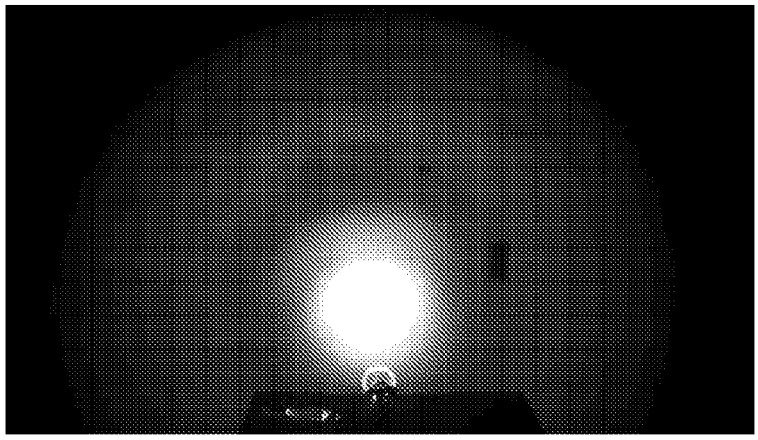
FIG. 18*a* is the lighting condition of a light source functioning without any anti-glare structure.
Figure 18B:
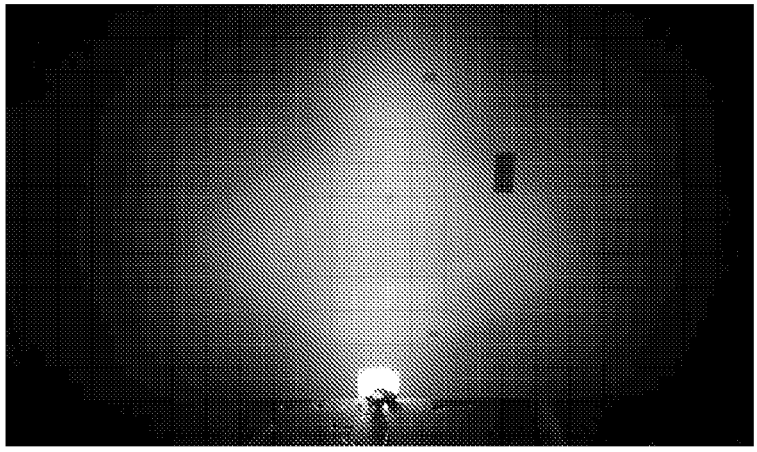
FIG. 18*b* is the light condition of a light source functioning with a conventional reflective filter.
Figure 18C:
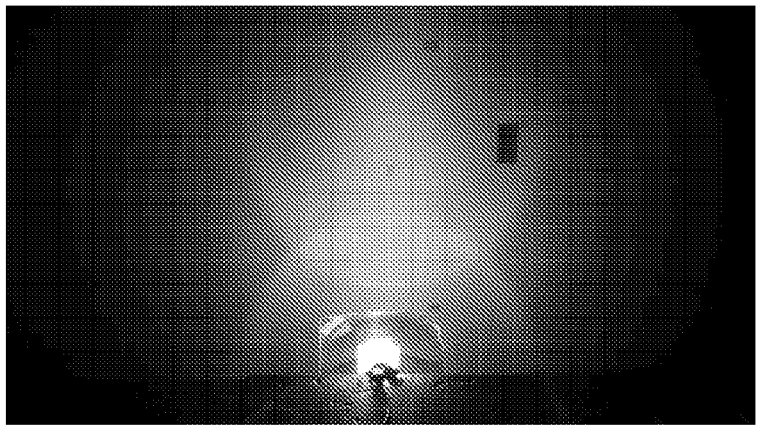
FIG. 18*c* is the light condition of a light source functioning with an anti-glare structure having a semi-Fresnel microstructure of the invention formed thereon.

It is noted that the uniformity of luminance and the light area of the lamp fixture can be controlled by the geometrical design of the semi-Fresnel microstructure and light-control microstructure. Experimentally, those microstructures of the invention practically have no affect on light intensity as they all have good light transmission efficiency. As seen in FIG. 18*a*, light of a light source emanating without helps of any anti-glare structure is collectively shining on a small area with unevenly distributed brightness. In FIG. 18*b*, the light condition of a light source functioning with a conventional reflective filter is improved as its light pattern is composed of two overlapping oval-shaped light in a crisscross manner that covers a much larger area than that of FIG. 18*a*. However, comparing with the brightness of FIG. 18*a*, it is much dimmer, representing that such structure can not collimate light effectively and thus have poor light utilization. Please refer to FIG. 18*c*, which is the light condition of a light source functioning with an anti-glare structure having a semi-Fresnel microstructure of the invention formed thereon. In FIG. 18*c*, the light condition of a light source functioning with semi-Fresnel microstructure is improved as its light pattern is composed of two semicircular-shaped light that covers more uniformly on a much larger area than that of FIG. 18*b*. Comparing with the lighting condition shown in FIG. 18*b*, not only the light of the light source can be collimated effectively by the semi-Fresnel microstructure without damaging to light utilization so that the brightness can be enhanced, but also the distribution of light and the illuminance uniformity can be improved by the light-control microstructure.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. An improved lamp fixture with anti-glare function, comprising:

a lamp;

a light source, disposed at a position over the lamp for providing light; and a light-control unit, disposed at a position over the lamp, further comprising:

a sheet-like substrate, having a rectangular portion, a first semi-circular portion, and a second semi-circular portion;

a semi-Fresnel microstructure, being disposed on the first semi-circular portion and the second semi-circular portion symmetrically, capable of diffusing/collimating light of the light source; and a light-control microstructure, being disposed on the rectangular portion, capable of controlling lighting angle of light discharging out of the lamp fixture for improving illuminance uniformity.

2. The lamp fixture of claim 1, wherein the semi-Fresnel microstructure is coplanar with the light-control microstructure.

3. The lamp fixture of claim 2, wherein the light-control microstructure and the semi-Fresnel microstructure are structured respectively as an array selected from the group consisting of a regular and an irregular array.

4. The lamp fixture of claim 2, wherein elements of the semi-Fresnel microstructure are disposed at two sides of the light-control microstructure in a symmetrical manner.

5. The lamp fixture of claim 1, wherein the semi-Fresnel microstructure is disposed on a surface of the sheet-like substrate different from that of the light-control microstructure.

6. The lamp fixture of claim 5, wherein the light-control microstructure and the semi-Fresnel microstructure are structured respectively as an array selected from the group consisting of a regular and an irregular array.

7. The lamp fixture of claim 1, wherein the sheet-like substrate is a flat sheet-like substrate.

8. The lamp fixture of claim 1, wherein one surface of the flat sheet-like substrate is formed with the semi-Fresnel microstructure and the light-control microstructure in a coplanar manner.

9. The lamp fixture of claim 1, further comprising:

a screen, mounted on the lamp and including:

at least a reflective surface, capable of reflecting light emitting from the light source; and at least a light exit, provided for receiving the light-control unit while allowing light to be discharged out of the screen therefrom.

10. The lamp fixture of claim 9, wherein rays emitting from the light source are reflected by the one reflective surface to shine on the light-control unit.

11. The lamp fixture of claim 9, wherein the light source is received inside the screen.

12. The lamp fixture of claim 9, wherein a reflective layer is formed on the reflective surface, the reflective layer being a reflective diffusing film, or an electroplating coating of a metal selected from the group consisting of aluminum, electroless nickel and the likes.

13. The lamp fixture of claim 1, wherein the lamp further comprises:

a base;

a post, mounted on the base and provided for the light source and the light-control unit to disposed thereon; and a switch, for controlling the actuation of the lamp.

14. The lamp fixture of claim 1, wherein the light source is at least a device selected from the group consisting of an incandescent bulb, a fluorescent lamp, a light emitted diode and the combination thereof.

15. The lamp fixture of claim 1, wherein rays of the light source is emanating to shine directly upon the light-control unit.

16. The lamp fixture of claim 1, wherein the semi-Fresnel microstructure is composed of a plurality of reflective micro-elements, each capable of reflecting light.

17. The lamp fixture of claim 1, wherein the semi-Fresnel microstructure is composed of a plurality of refractive micro-elements, each capable of refracting light.

18. The lamp fixture of claim 1, wherein the light-control microstructure is a composition of microstructures, each selected from the group consisting of a refractive microelement, a diffusion micro-particle, a diffusion pore and the combination thereof.

19. The lamp fixture of claim 18, wherein the size of each microstructure is ranged between several microns and hundreds of microns.

20. The lamp fixture of claim 18, wherein the cross section of each microstructure is defined by a profile selected from the group consisting of an arc, a saw-toothed line, other irregular lines and the combination thereof.

21. The lamp fixture of claim 1, wherein the light-control microstructure is substantially a microstructure array of symmetrical or unsymmetrical shape.

* * * * *